US005908998A

United States Patent [19]

Blucher et al.

[11] Patent Number: 5,908,998

[45] Date of Patent: Jun. 1, 1999

[54] HIGH INDUCTANCE ELECTROMAGNETIC PICKUP FOR STRINGED MUSICAL INSTRUMENTS

[75] Inventors: Steven L. Blucher, New York; Michael T. Altilio, Staten Island, both of N.Y.

[73] Assignee: DiMarzio, Inc., Staten Island, N.Y.

[21] Appl. No.: 08/807,060

[22] Filed: Feb. 27, 1997

[51] Int. Cl.[6] ..... G10H 3/08

[52] U.S. Cl. ..... 84/728; 84/723; 84/725; 84/DIG. 24

[58] Field of Search ..... 84/723, 725–728, 84/DIG. 24, 730–731

[56] References Cited

U.S. PATENT DOCUMENTS

| | | | |
|---|---|---|---|
| 2,896,491 | 7/1959 | Lover | 84/1.15 |
| 3,588,311 | 6/1971 | Zoller | 84/1.15 |
| 3,711,619 | 1/1973 | Jones et al. | 84/1.15 |
| 3,916,751 | 11/1975 | Stich | 84/1.15 |
| 4,372,186 | 2/1983 | Aaroe | 84/1.15 |
| 4,442,749 | 4/1984 | DiMarzio et al. | 84/1.15 |
| 4,501,185 | 2/1985 | Blucher | 84/1.15 |
| 4,809,578 | 3/1989 | Lace, Jr. | 84/1.15 |
| 5,111,728 | 5/1992 | Blucher et al. | 84/726 |
| 5,221,805 | 6/1993 | Lace | 84/726 |
| 5,354,949 | 10/1994 | Zwaan | 84/727 |
| 5,399,802 | 3/1995 | Blucher | 84/726 |
| 5,530,199 | 6/1996 | Blucher | 84/728 |
| 5,668,520 | 9/1997 | Kinman . | |

*Primary Examiner*—Stanley J. Witkowski
*Assistant Examiner*—Marlon T. Fletcher
*Attorney, Agent, or Firm*—Baker & Botts, L.L.P.

[57] ABSTRACT

An electromagnetic pickup for stringed musical instruments has at least one bobbin mountable to the instrument beneath the instrument's strings, each of the bobbins having a body and a coil wrapped around the body, the body having one or more holes therethrough positioned below the strings. A magnetic device for generating a magnetic field around the bobbins and one or more pole pieces extended through the holes is also included. Ferromagnetic material is positioned within the body of one or more of the bobbins or between the bobbin(s) and the musical instrument to increase the device's inductance.

47 Claims, 4 Drawing Sheets

HIGH INDUCTANCE ELECTROMAGNETIC PICKUP FOR STRINGED MUSICAL INSTRUMENTS

SPECIFICATION

This invention relates to transducers, or electromagnetic pickups, for musical instruments and more particularly, to pickups for electrical string instruments which provide a truer, more pleasing tonal quality through increasing inductance, while maintaining a lower impedance.

BACKGROUND OF THE INVENTION

As described in U.S. Pat. No. 4,501,185, granted Feb. 26, 1985 to one of the inventors named in this application, Steven Blucher, electromagnetic pickups are used with stringed musical instruments, such as electric guitars, to convert the vibrations of "picked" strings into electrical signals for subsequent amplification into sound. The pickups usually comprise a magnet system, including one or more permanent magnet elements and one or more pole pieces made of magnetic or ferromagnetic material to establish a magnetic field within which the strings vibrate, and coils wound on one or more bobbins disposed in the field to generate electrical signals corresponding to flux variations in the field due to the strings' vibrations. These electrical signals are amplified into musical sounds by circuits and equipment well-known to those skilled in the art.

Although the embodiments presented herein include pole pieces, it should be understood by those skilled in the art that one or more permanent magnets may be positioned within the pickup's bobbin body or bodies, in a manner such that the top and bottom edges of the magnet constitute different polarities, without the necessity of pole pieces of any kind. Furthermore, where pole pieces are used and constitute actual magnet devices, it is known in the art that a separate permanent magnet element is not necessary to create the magnetic field.

Typically, where pole pieces are used in the pickup implementation, they are disposed through holes in the bobbins and the pickup itself is generally mounted on the face of the instrument so that at least one pole piece is situated below each string. The bobbins are arranged so that the pole pieces are within the coils to allow the magnetic field developed by the pole pieces and/or permanent magnet to envelope the coil. Each string, when set into motion, causes variations in the magnetic field in the vicinity of the pole piece or pieces and the variations are converted into electrical signals by the interaction of the magnetic field with the coil.

It is generally understood by those skilled in the art that the efficiency of an electromagnetic pickup is measured by how much output voltage can be produced with the smallest amount of impedance, resistance and inductance. Unfortunately, pickup efficiency has often been sacrificed in the prior art due to other concerns. For example, as discussed in U.S. Pat. No. 5,530,199, granted Jun. 25, 1996 also to Mr. Blucher, the introduction of a second coil to cancel hum in a standard hum-cancelling pickup is accompanied by an increase in resistance, impedance and inductance, thus reducing the efficiency of the pickup.

A common complaint regarding the tonality of electric guitars (as well as other electronic stringed instruments) is that the sound produced is too harsh. This harshness is particularly evident at higher pitches. One way of eliminating or reducing the harshness has been to increase the number of turns of wire in the coil or coils. However, doing so also increases the inductance, resistance and capacitance, resulting in a higher impedance of the pickup. This has the undesirable result of reducing the pickup's efficiency and dulling the instrument's tonality, especially at the lower pitches.

While it is known in the prior art that the inductance of a magnetic transducer (or pickup) will have a direct bearing on the tonality or sound produced by the instrument, no attempt has been made to adjust the amount of inductance of a pickup, independent of the other parameters which contribute to the impedance of the pickup.

It is a primary object of the present invention to provide an electromagnetic pickup having a reduced sonic harshness due to an increased inductance without a corresponding increased DC resistance or capacitance A further object of the present invention is to provide such results in a hum-cancelling pickup while maintaining the pickup's hum-cancelling capability

SUMMARY OF THE INVENTION

The present invention overcomes the prior art limitations by providing additional ferromagnetic material in the gaps between the pole pieces of a pickup bobbin and/or beneath, around and/or in close proximity to the bobbin. This arrangement has the advantage of increasing the inductance of the pickup without causing a corresponding increase in the pickup's DC resistance and impedance. Thus, a sound with better tonality and less harshness results.

The invention provides an electromagnetic pickup device for a stringed musical instrument having at least one bobbin mountable to the instrument beneath the instrument's strings, each of the bobbins having a body and a coil wrapped around the body, the body having one or more holes therethrough positioned below the strings. A magnetic device for generating a magnetic field around the bobbins and one or more pole pieces extended through the holes are also included. A crucial part of the invention is the presence of ferromagnetic material positioned within the body of one or more of the bobbins and/or beneath, around and/or in close proximity to the body to increase the device's inductance. The material may be specifically placed between the bobbin(s) and the musical instrument.

It is preferable that the magnetic device include at least one permanent magnet positioned in close proximity to the bobbins to create the magnetic field therearound. The first edge of the magnet preferably constitutes a magnetic north pole and the second edge of the magnet preferably constitutes a magnetic south pole.

In one preferred embodiment, the ferromagnetic material is positioned between the holes of the body of one or more of the bobbins and is cylindrically shaped like plugs.

In another preferred embodiment, the ferromagnetic material is positioned beneath the body of one or more of the bobbins. Preferably, ferromagnetic material is shaped in the form of one or more strips attached to at least one of the edges of the magnet. Preferably, the magnet has at least one metallic strip attached to one of more of its edges and the one or more strips of ferromagnetic material are attached to an outer edge of the metallic strip(s).

It is also preferable in these embodiments for the electromagnetic pickup to have a first and a second hum-cancelling bobbin. Preferably, the first hum-cancelling bobbin has a gauge of wire different from the second hum-cancelling bobbin such that the second hum-cancelling bobbin has a resonant frequency lower than that of the first hum-cancelling bobbin. In this arrangement, the ferromagnetic material is, preferably, positioned within or beneath the body of the second hum-cancelling bobbin, thereby further emphasizing and accentuating the differing frequencies.

Another preferred embodiment of the present invention provides an electromagnetic pickup device for a stringed musical instrument having an upper bobbin positioned above a lower bobbin, each of the bobbins having a body and a coil of wire wrapped around the body. In this configuration, the bobbins are mountable on the instrument below the strings. The coils have axes perpendicular to the strings and at least one of the bobbin bodies has two or more holes therethrough which may be positioned below the strings when the device is mounted to the instrument. Also included are a magnetic device for generating a magnetic field around the bobbins and one or more magnets (pole pieces) extended through the holes. Again, a crucial part of the invention is ferromagnetic material which is positioned within or beneath the lower bobbin body to increase the device's inductance as described above.

Preferably, the upper bobbin coil has more turns of wire than the lower bobbin coil and the wire of the lower bobbin coil has a heavier gauge than the wire of the upper bobbin coil.

It is also preferable to include an integral plate of magnetic material having a base disposed between the bobbins perpendicular to the coil axes and two side walls extending upwardly and perpendicularly from the base about the bobbin.

One advantage of increasing the inductance of the lower passive hum-cancelling bobbin is that it permits the number of wire turns of the upper bobbin to be higher than the number of turns of the lower bobbin. Substantially reducing the number of turns of the lower bobbin while maintaining or increasing the turns of the upper bobbin has the positive effect of lowering the impedance of the pickup at higher frequencies, which will enhance the amplitude and quality of the pickup's treble response. By employing a heavier gauge of wire in the lower bobbin than in the upper bobbin, DC resistance of the pickup is further reduced.

If a further increase in inductance were required for a specific application, additional ferromagnetic material might be positioned between the magnets of the upper bobbin, and properly balanced by the correct gauge and number of turns of wire on the lower bobbin. This configuration serves to maintain the hum-cancelling capabilities of the pickup.

In all the embodiments, it is preferable for the pole pieces to be aligned with the strings.

BRIEF DESCRIPTION OF THE DRAWING

Further objects, features and advantages of the invention will become apparent from the following detailed description taken in conjunction with the accompanying figures in which.

Figure 1:
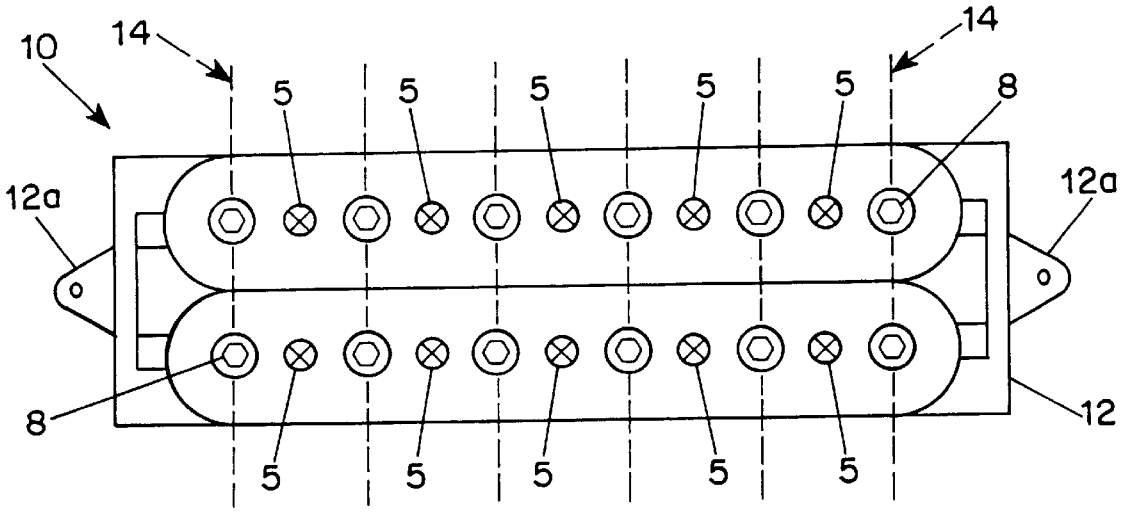
FIG. 1 is a top view of a pickup in accordance with a preferred embodiment of the invention.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION

Figure 2:
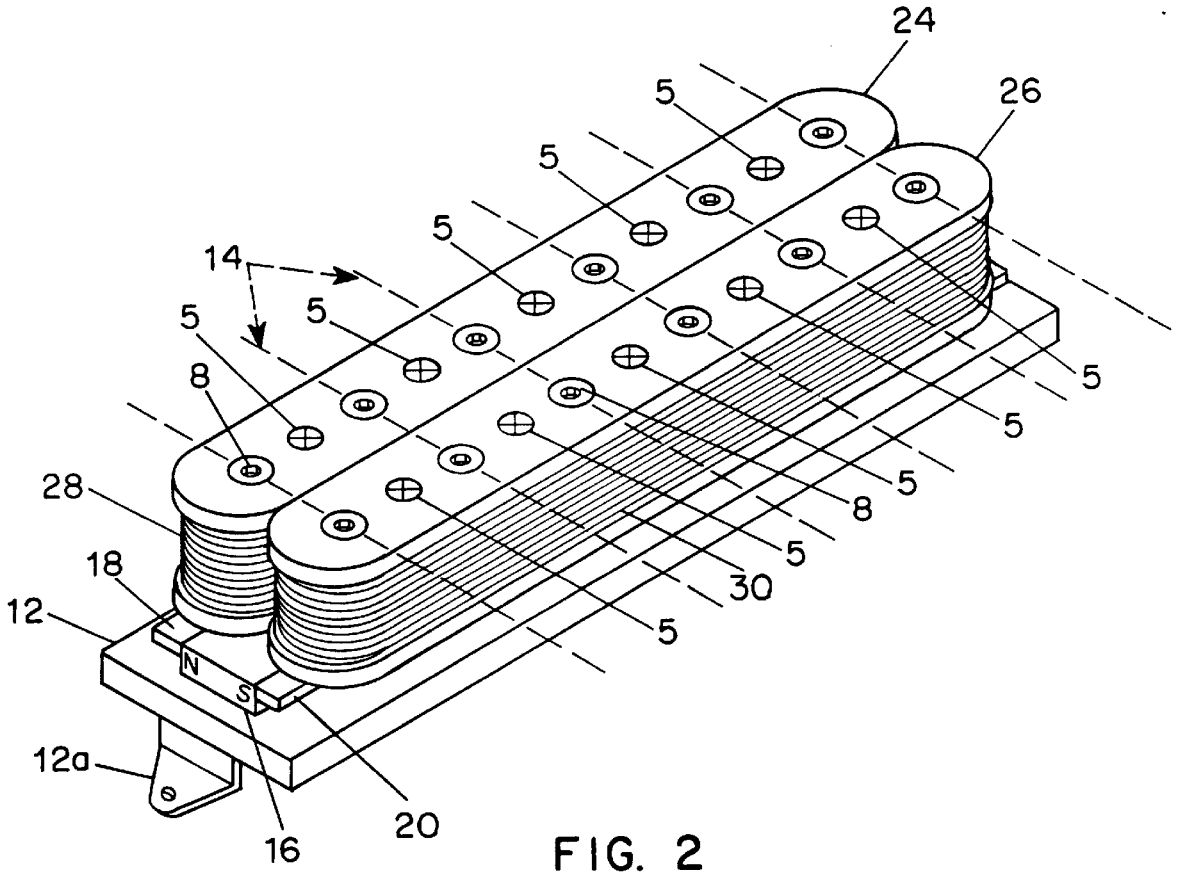
FIG. 2 is a perspective view of the pickup of FIG. 1.

FIGS. 1 and 2 illustrate one of the preferred embodiments of the present invention. While pickup 10 is shown to be a dual-coil pickup, the present invention can be similarly applied to a standard single coil pickup such as those disclosed in U.S. Pat Nos. 3,588,311 and 3,711,619. Pickup 10 includes base plate 12 consisting of a rigid, non-magnetic material suitable for mounting to the face of a stringed musical instrument such as an electric guitar (not shown). To enable mounting, base plate 12 includes mounting foot 12*a* at each of the plate's two ends. The strings 14 of the instrument are shown schematically by dashed lines. Permanent magnet 16, having one longitudinal edge portion constituting a magnetic north pole and an opposing longitudinal edge portion constituting a magnetic south pole (as designated in FIG. 2), is positioned on base plate 12. Alternately, more than one magnet may be used to create the magnetic field. Magnet 16 is preferably about as long as base plate 12 and may be positioned between two metallic strips 18 and 20 which bear against magnet 16. Metallic strips 18 and 20 are of appropriate magnetizable material and their length is, preferably, about the same as that of magnet 16, Thus, strip 18 constitutes a magnetic north pole and strip 20 constitutes a magnetic south pole.

Strips 18 and 20 have holes so that threaded pole pieces 8 may pass therethrough. Pole pieces 8 are made of metallic and magnetizable material and are conveniently placed or threaded into corresponding holes in base plate 12. Pole pieces 8 are positioned below the strings 14 of the musical instrument and may be individually adjusted (by threading more or less into the base plate 12) to vary the spacing between pole pieces 8 and strings 14.

Bobbins 24 and 26 each have a body made of non-electrically conductive, non-magnetic and non-magnetizable material. Pole pieces 8 pass through holes in the bodies of bobbins 24 and 26 before entering holes in strips 18 and 20 and base plate 12.

Coils 28 and 30 are wound about the bodies of bobbins 24 and 26, respectively. The coils may be formed of 5,000 turns of 42 gauge insulated copper wire, of 10,000 turns of 50 gauge wire, or of some other combination known to those in the art. The coils also may use different gauges of wire, as disclosed in U.S. Pat. No. 4,501,185.

Figure 3:
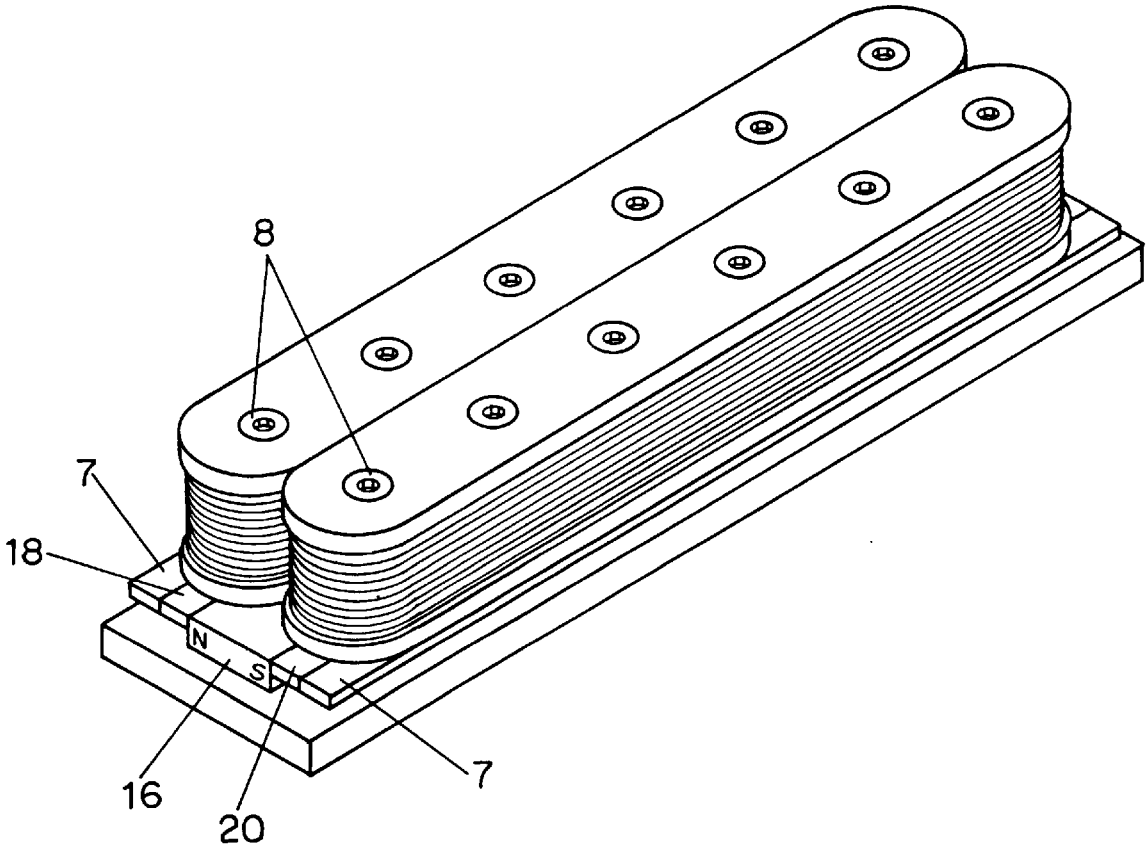
FIG. 3 is a perspective view of a pickup in accordance with a second embodiment of the invention.

In accordance with the invention, ferromagnetic material, preferably in the form of cylinders or plugs 5, are disposed in the body of the bobbins 24 and 26 between the pole pieces 8. In a second embodiment of the present invention, shown in FIG. 3, strips 7 of ferromagnetic material are positioned between the bobbins (24, 26) and the base plate 12 and are adjoining the outside edges of and in the same plane as metallic strips 18 and/or 20. These strips 7 may be positioned adjoining only one of the metallic strip edges (18, 20) or may be disposed directly alongside magnet 16 in a configuration without metallic strips. The additional ferromagnetic material increases the inductance of the pickup without increasing the DC resistance. In a single coil pickup (not illustrated), the plugs 5 and/or strips 7 would be similarly disposed as they are in either of bobbins 24 or 26.

In the embodiment of the hum-cancelling pickup of U.S. Pat. No. 4,501,185, herein incorporated by reference, a first hum-cancelling bobbin has a gauge of wire different from a second hum-cancelling bobbin such that the second bobbin has a resonant frequency lower than the first bobbin. In this embodiment, the ferromagnetic plugs 5 or strips 7 are, preferably, applied to the bobbin having the lower resonant frequency to further emphasize and accentuate the differing frequencies.

Figure 4:
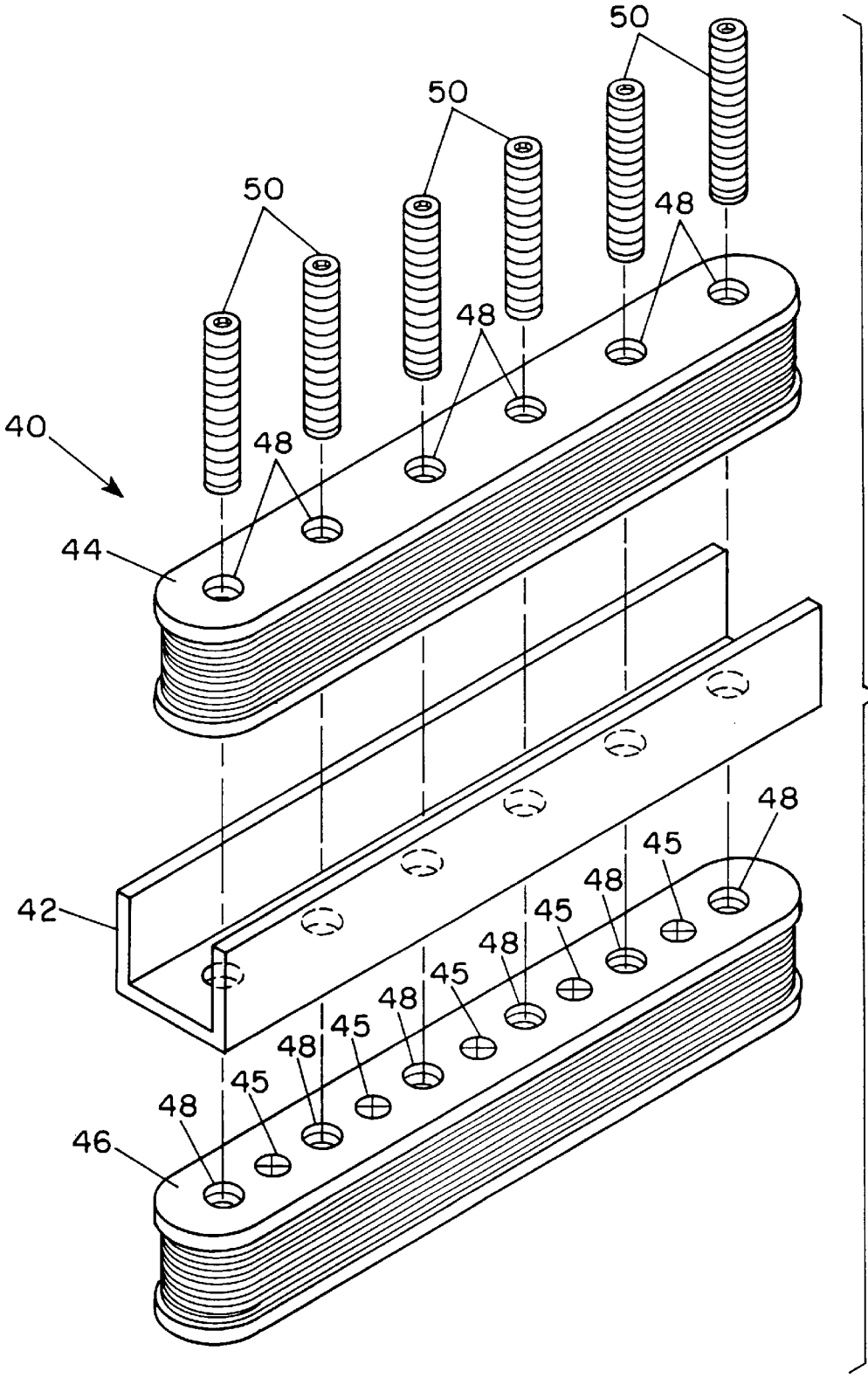
FIG. 4 is a perspective view of a pickup in accordance with a third embodiment of the invention.

FIG. 4 illustrates another embodiment of the present invention. As described in U.S. Pat. No. 4,442,749, herein incorporated by reference, bobbins 44 and 46 are positioned in a vertical, rather than horizontal, configuration of a pickup 40. While bobbin 44 senses the vibration of the strings, bobbin 46 functions passively to cancel hum. Preferably, the bobbins are separated by a plate 42 which is constructed from a single piece of ferromagnetic material. Plate 42 creates a focused magnetic field immediately above the pickup to increase the signal weakened by the vertical configuration. In addition, plate 42 increases the inductance of pickup 40. By increasing or decreasing the thickness of plate 42 and using materials of various permeabilities, the inductance of pickup 40 can be increased or decreased to control the tone produced.

Figure 5:
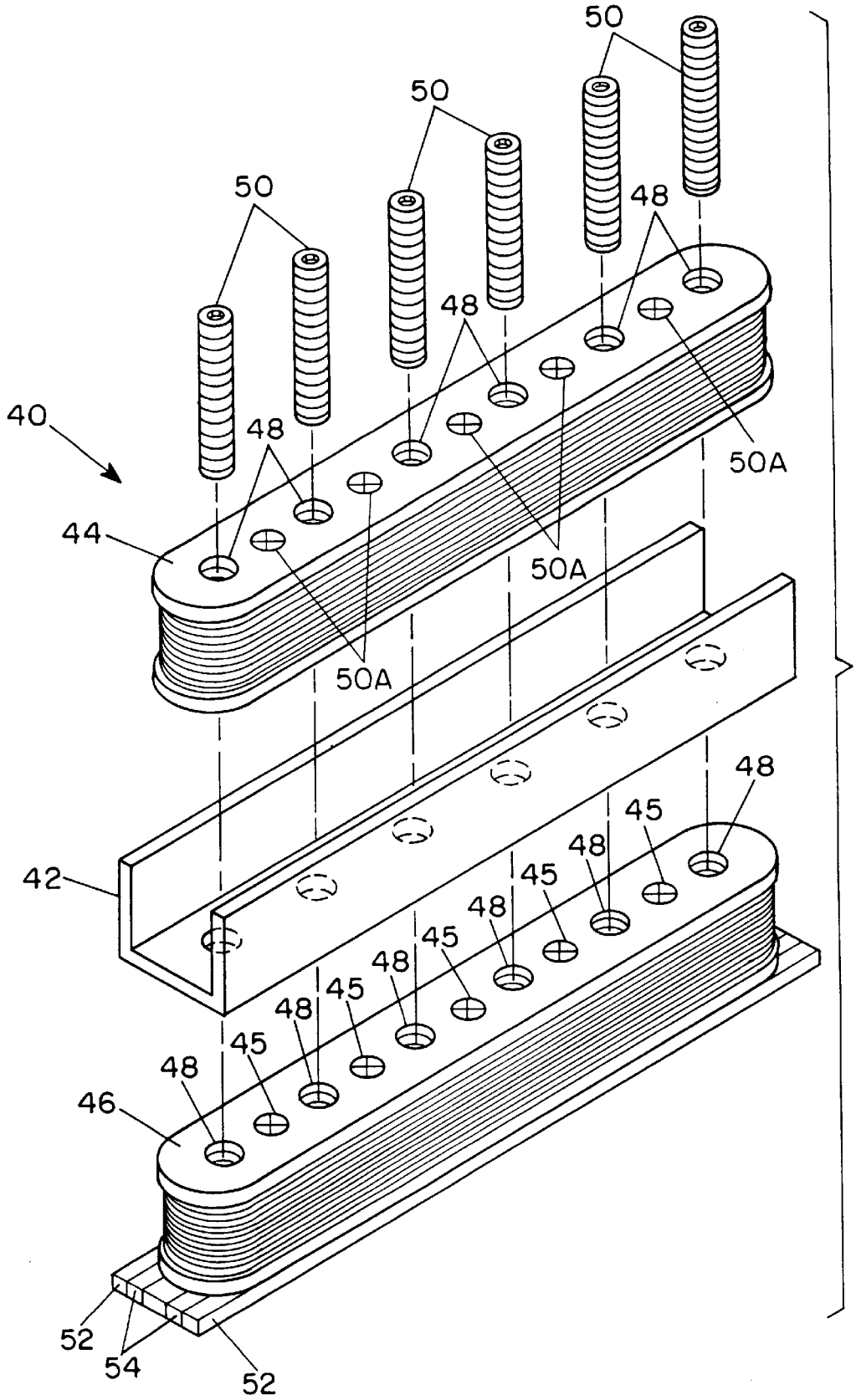
FIG. 5 is a perspective view of a pickup in accordance with a fourth embodiment of the invention.

In FIG. 4, holes 48 in bobbin 44 receive pole pieces 50 and ferromagnetic material 45 is disposed between holes 48 in passive bobbin 46, according to one embodiment of the invention, to increase its inductance. Alternatively, ferromagnetic material 45 may be disposed either within or between holes 48 of bobbin 46. Bobbin 46 may also be provided without holes in its body (not shown), in which case ferromagnetic material may be positioned anywhere within its body to achieve the objectives of the invention. In an embodiment where both plate 42 and bobbin 46 have holes to receive pole pieces 50 which extend only partially into bobbin 46, additional ferromagnetic material may also be inserted in holes 48 of bobbin 46 below pole pieces 50. Ferromagnetic material 50 may also be positioned between the holes 48 of the upper bobbin 44, as shown in FIG. 5.

As described above, the ferromagnetic material may also take the form of strips 52 positioned beneath the body of bobbin 46 adjoining the outside edges 54 of metallic strips. Preferably, the number of wire turns in the coil of bobbin 46 is reduced while maintaining or increasing the number of wire turns in the coil of bobbin 44. Finally, the gauge of wire on the coil of bobbin 46 is preferably heavier than that on the coil of bobbin 44.

Other modifications of the invention will occur to those skilled in the art such as placing the additional ferromagnetic material in different locations, e.g., between two or more bobbins, and it is intended that the scope of the invention be limited only as set forth in the appended claims.

We claim:

1. An electromagnetic pickup device having an inductance for a stringed musical instrument having a plurality of ferromagnetic strings, comprising:

first and second bobbins, each having a body mountable on said instrument proximate and below said strings and a coil wrapped around said body, at least one of said bodies having a plurality of holes therethrough;

a magnetic device for generating a magnetic field around said bobbins; and ferromagnetic material selectively positioned within at least one of said bodies to increase said inductance without causing a corresponding increase in said pickup's DC resistance and to effectively cancel externally generated hum and noise.

2. The electromagnetic pickup of claim 1 wherein said magnetic device comprises a plurality of pole pieces extended through said holes.

3. An electromagnetic pickup device having an inductance for a stringed musical instrument having a plurality of ferromagnetic strings, comprising:

first and second bobbins, each having a body mountable on said instrument proximate and below said strings and a coil wrapped around said body, at least one of said bodies having a plurality of holes therethrough;

a magnetic device for generating a magnetic field around said bobbins;

a plurality of pole pieces extended through said holes; and ferromagnetic material selectively positioned within at least one of said bodies to increase said inductance without causing a corresponding increase in said pickup's DC resistance and to effectively cancel externally generated hum and noise.

4. The electromagnetic pickup of claim 3 wherein said ferromagnetic material is cylindrically shaped.

5. The electromagnetic pickup of claim 3 wherein said pole pieces are aligned with said strings.

6. The electromagnetic pickup of claim 3 wherein said magnetic device includes at least one permanent magnet having a first edge and a second edge of opposite polarities, said magnet positioned in close proximity to said at least one bobbin to create said magnetic field therearound.

7. The electromagnetic pickup of claim 6 wherein said first edge of said magnet constitutes a magnetic north pole and said second edge of said magnet constitutes a magnetic south pole.

8. An electromagnetic pickup device having an inductance for a stringed musical instrument having a plurality of ferromagnetic strings, comprising:

first and second hum-cancelling bobbins, each having a body mountable on said instrument proximate and below said strings and a coil wrapped around said body, at least one of said bodies having a plurality of holes therethrough;

a magnetic device for generating a magnetic field around said bobbins;

a plurality of pole pieces extended through at least a plurality of said holes; and ferromagnetic material positioned between said holes of said body to increase said inductance, wherein said first hum-cancelling bobbin has a gauge of wire different from said second hum-cancelling bobbin such that said second hum-cancelling bobbin has a resonant frequency lower than said first hum-cancelling bobbin and wherein said ferromagnetic material is positioned within said body of said second hum-cancelling bobbin.

9. An electromagnetic pickup device having an inductance for a stringed musical instrument having a plurality of ferromagnetic strings, comprising:

first and second bobbins, each having a body mountable on said instrument proximate and below said strings and a coil wrapped around said body;

a magnetic device for generating a magnetic field around said bobbins; and ferromagnetic material selectively positioned between said bodies and said musical instrument to increase said inductance without causing a corresponding increase in said pickup's DC resistance and to effectively cancel externally generated hum and noise.

10. The electromagnetic pickup of claim 9 wherein said body has one or more holes therethrough and said magnetic device comprises one or more pole pieces extended through said one or more holes.

11. An electromagnetic pickup device having an inductance for a stringed musical instrument having a plurality of ferromagnetic strings, comprising:

first and second bobbins, each having a body mountable on said instrument proximate and below said strings and coil wrapped around said body;

a magnetic device for generating a magnetic field around said bobbins: and ferromagnetic material selectively positioned within said body to increase said inductance without causing a corresponding increase in said pickup's DC resistance and to effectively cancel externally generated hum and noise.

12. The electromagnetic pickup of claim 11 wherein said body has one or more holes therethrough and said magnetic device comprises one or more pole pieces extended through said one or more holes.

13. An electromagnetic pickup device having an inductance for a stringed musical instrument having a plurality of ferromagnetic strings, comprising:

first and second bobbins, each having a body mountable on said instrument proximate and below said strings and a coil wrapped around said body, at least one, of said bodies having one or more holes therethrough;

a magnetic device for generating a magnetic field around said bobbins;

one or more pole pieces extended through said one or more holes; and ferromagnetic material selectively positioned between said bodies and said musical instrument to increase said inductance without causing a corresponding increase in said pickup's DC resistance and to effectively cancel externally generated hum and noise.

14. The electromagnetic pickup of claim 13 wherein said pole pieces are aligned with said strings.

15. The electromagnetic pickup of claim 13 wherein said magnetic device includes at least one permanent magnet having a first edge and a second edge of opposite polarities, said magnet positioned in close proximity to said at least one bobbin to create said magnetic field therearound.

16. The electromagnetic pickup of claim 15 wherein said first edge of said magnet constitutes a magnetic north pole and said second edge of said magnet constitutes a magnetic south pole.

17. The electromagnetic pickup of claim 16 wherein said ferromagnetic material is shaped in the form of one or more strips adjoining at least one edge of said magnet.

18. The electromagnetic pickup of claim 16 wherein said magnetic device further comprises at least one metallic strip attached to one or more of said edges of said magnet, said at least one metallic strip dimensioned to receive one or more of said pole pieces and wherein said ferromagnetic material is shaped in the form of one or more strips adjoining an outer edge of said at least one metallic strip.

19. An electromagnetic pickup device having an inductance for a stringed musical instrument having a plurality of ferromagnetic strings, comprising:

an upper bobbin having an upper bobbin body and an upper bobbin coil of wire wrapped around said upper bobbin body;

a lower bobbin positioned below and coaxial to said upper bobbin, said lower bobbin having a lower bobbin body and an lower bobbin coil of wire wrapped around said lower bobbin body, said bodies mountable on said instrument proximate and below said strings, said coils having axes perpendicular to said strings;

a magnetic device for generating a magnetic field around said bobbins; and ferromagnetic material positioned within said lower bobbin body to increase said inductance.

20. The electromagnetic pickup of claim 19 wherein said at least one of said bodies has a plurality of holes therethrough and said magnetic device comprises a plurality of pole pieces extended through said holes.

21. An electromagnetic pickup device having an inductance for a stringed musical instrument having a plurality of ferromagnetic strings, comprising:

an upper bobbin having an upper bobbin body and an upper bobbin coil of wire wrapped around said upper bobbin body;

a lower bobbin positioned below and coaxial to said upper bobbin, said lower bobbin having a lower bobbin body and an lower bobbin coil of wire wrapped around said lower bobbin body, said bodies mountable on said instrument proximate and below said strings, said coils having axes perpendicular to said strings and at least one of said bodies having a plurality of holes therethrough;

a magnetic device for generating a magnetic field around said bobbins;

a plurality of pole pieces extended through said holes; and ferromagnetic material positioned within said lower bobbin body to increase said inductance.

22. The electromagnetic pickup of claim 21 wherein said ferromagnetic material is positioned between said holes of said lower bobbin body.

23. The electromagnetic pickup of claim 21 wherein said ferromagnetic material is further positioned between said holes of said upper bobbin body.

24. The electromagnetic pickup of claim 22 or 23 wherein said ferromagnetic material is cylindrically shaped.

25. The electromagnetic pickup of claim 21 wherein said pole pieces are aligned with said strings.

26. The electromagnetic pickup of claim 21 further comprising an integral plate of magnetic material having a base disposed between said bobbins perpendicular to said coil axes and two side walls extending upwardly and perpendicularly from said base about said upper bobbin.

27. The electromagnetic pickup of claim 21 wherein said magnetic device includes at least one permanent magnet having a first edge and a second edge of opposite polarities, said magnet positioned in close proximity to said lower bobbin to create said magnetic field around said bobbins.

28. The electromagnetic pickup of claim 27 wherein said first edge of said magnet constitutes a magnetic north pole and said second edge of said magnet constitutes a magnetic south pole.

29. An electromagnetic pickup device having an inductance for a stringed musical instrument have a plurality of ferromagnetic strings, comprising:

an upper bobbin having an upper bobbin body and an upper bobbin coil of wire wrapped around said upper bobbin body;

a lower bobbin positioned below the coaxial to said upper bobbin, said lower bobbin having a lower bobbin body and an lower bobbin coil of wire wrapped around said lower bobbin body, said bodies mountable on said instrument proximate and below said strings, said coils having axes perpendicular to said strings and at least one of said bodies having a plurality of holes therethrough;

a magnetic device for generating a magnetic field around said bobbins;

a plurality of pole pieces extended through said holes; and ferromagnetic material positioned within said lower bobbin body to increase said inductance, wherein said upper bobbin coil has more turns of wire than said lower bobbin coil.

30. An electromagnetic pickup device having an inductance for a stringed musical instrument have a plurality of ferromagnetic strings, comprising:

an upper bobbin having an upper bobbin body and an upper bobbin coil of wire wrapped around said upper bobbin body;

a lower bobbin positioned below and coaxial to said upper bobbin, said lower bobbin having a lower bobbin body and an lower bobbin coil of wire wrapped around said lower bobbin body, said bodies mountable on said instrument proximate and below said strings, said coils having axes perpendicular to said strings and at least one of said bodies having a plurality of holes therethrough;

a magnetic device for generating a magnetic field around said bobbins;

a plurality of pole pieces extended through said holes; and ferromagnetic material positioned within said lower body to increase said inductance, wherein said wire of said lower bobbin coil has a heavier gauge than said wire of said upper bobbin coil.

31. An electromagnetic pickup device having an inductance for a stringed musical instrument having a plurality of ferromagnetic strings, comprising:

an upper bobbin having an upper bobbin body and an upper bobbin coil of wire wrapped around said upper bobbin body;

a lower bobbin positioned below and coaxial to said upper bobbin, said lower bobbin having a lower bobbin body and an lower bobbin coil of wire wrapped around said lower bobbin body, said bodies mountable on said instrument proximate and below said strings, said coils having axes perpendicular to said strings;

a magnetic device for generating a magnetic field around said bobbins; and ferromagnetic material positioned beneath said lower bobbin body to increase said inductance.

32. The electromagnetic pickup of claim 31 wherein said at least one of said bodies has a plurality of holes therethrough and said magnetic device comprises a plurality of pole pieces extended through said holes.

33. An electromagnetic pickup device having an inductance for a stringed musical instrument having a plurality of ferromagnetic strings, comprising:

an upper bobbin having an upper bobbin body and an upper bobbin coil of wire wrapped around said upper bobbin body;

a lower bobbin positioned below and coaxial to said upper bobbin, said lower bobbin having a lower bobbin body and an lower bobbin coil of wire wrapped around said lower bobbin body, said bodies mountable on said instrument proximate and below said strings, said coils having axes perpendicular to said strings;

a magnetic device for generating a magnetic field around said bobbins; and ferromagnetic material positioned within at least one of said bodies to increase said inductance.

34. The electromagnetic pickup of claim 33 wherein said at least one of said bodies has a plurality of holes therethrough and said magnetic device comprises a plurality of pole pieces extended through said holes.

35. An electromagnetic pickup device having an inductance for a stringed musical instrument having a plurality of ferromagnetic strings, comprising:

an upper bobbin having an upper bobbin body and an upper bobbin coil of wire wrapped around said upper bobbin body;

a lower bobbin positioned below and coaxial to said upper bobbin, said lower bobbin having a lower bobbin body and an lower bobbin coil of wire wrapped around said lower bobbin body, said bodies mountable on said instrument proximate and below said strings, said coils having axes perpendicular to said strings and at least one of said bodies having a plurality of holes therethrough;

a magnetic device for generating a magnetic field around said bobbins;

a plurality of pole pieces extended through said holes; and ferromagnetic material positioned beneath said lower bobbin body to increase said inductance.

36. The electromagnetic pickup of claim 35 wherein said pole pieces are aligned with said strings.

37. The electromagnetic pickup of claim 35 further comprising an integral plate of magnetic material having a base disposed between said bobbins perpendicular to said coil axes and two side walls extending upwardly and perpendicularly from said base about said upper bobbin.

38. The electromagnetic pickup of claim 35 wherein said magnetic device includes at least one permanent magnet having a first edge and a second edge of opposite polarities, said magnet positioned in close proximity to said lower bobbin to create said magnetic field around said bobbins.

39. The electromagnetic pickup of claim 38 wherein said first edge of said magnet constitutes a magnetic north pole and said second edge of said magnet constitutes a magnetic south pole.

40. The electromagnetic pickup of claim 39 wherein said ferromagnetic material is shaped in the form of one or more strips adjoining to at least one edge of said magnet.

41. The electromagnetic pickup of claim 38 wherein said magnetic device further comprises at least one metallic strip attached to one or more of said edges of said magnet, said at least one magnetic strip dimensioned to receive one or more of said pole pieces and wherein said ferromagnetic material is shaped in the form of one or more strips adjoining to an outer edge of said at least one metallic strip.

42. An electromagnetic pickup device having an inductance for a stringed musical instrument having a plurality of ferromagnetic strings, comprising: first and second bobbins, each having a body mountable on said instrument proximate and below said strings and a coil of wire wrapped around said body, said coil of said first bobbin having more turns of wire than said coil of said second bobbin, and ferromagnetic material added to said second bobbin to increase said inductance and to effectively cancel externally generated hum and noise.

43. A method of making an electromagnetic pickup device having an inductance for a stringed musical instrument having a plurality of ferromagnetic strings, comprising the following steps:

providing two bobbins each having a body mountable on said instrument proximate and below said strings;

providing two coils, one wrapped around one of said bodies, and the other coil wrapped around the other of said bodies, said coils having a different number of turns of wire;

adding ferromagnetic material to that body having the coil with fewer turns to increase said inductance and to effectively cancel externally generated hum and noise.

44. The method of claim 43 wherein said coil with fewer turns is provided below said coil with greater turns.

45. An electromagnetic pickup device having an inductance for a stringed musical instrument having a plurality of ferromagnetic strings, comprising: first and second bobbins, each having a body mountable on said instrument proximate and below said strings and a coil of wire wrapped around said body, said coil of said first bobbin having a lighter gauge of wire than said coil of said second bobbin, and ferromagnetic material added to said second bobbin to increase said inductance and to effectively cancel externally generated hum and noise.

46. A method of making an electromagnetic pickup device having an inductance for a stringed musical instrument having a plurality of ferromagnetic strings, comprising the following steps:

providing two bobbins each having a body mountable on said instrument proximate and below said strings;

providing two coils, one wrapped around one of said bodies, and the other coil wrapped around the other of said bodies, said coils having different gauges of wire;

adding ferromagnetic material to that body having the coil with the heavier gauge of wire to increase said inductance and to effectively cancel externally generated hum and noise.

47. The method of claim 46 wherein said coil with heavier gauge is provided below said coil with lighter gauge.

* * * * *

UNITED STATES PATENT AND TRADEMARK OFFICE

CERTIFICATE OF CORRECTION

PATENT NO. : 5,908,998
DATED : June 1, 1999
INVENTOR(S) : Steven L. Blucher et al It is certified that error appears in the above-identified patent and that said Letters Patent is hereby corrected as shown below:

IN THE CLAIMS:

Column 7, line 27, claim 13: "one, of" should read -- one of --.

Column 8, line 7, claim 19: "material positioned" should read -- material selectively positioned --.

Column 8, line 8, claim 19: "inductance." should read -- inductance without causing a corresponding increase in said pickup's DC resistance and to effectively cancel externally generated hum and noise. --.

Column 8, line 30, claim 21: "material positioned" should read -- material selectively positioned --.

UNITED STATES PATENT AND TRADEMARK OFFICE

CERTIFICATE OF CORRECTION

PATENT NO. : 5,908,998

DATED : June 1, 1999

INVENTOR(S) : Steven L. Blucher et al

It is certified that error appears in the above-identified patent and that said Letters Patent is hereby corrected as shown below:

Column 8, line 31, claim 21: "inductance." should read -- inductance without causing a corresponding increase in said pickup's DC resistance and to effectively cancel externally generated hum and noise. --.

Column 8, line 63, claim 29: "the" should read -- and --.

Column 9, line 47, claim 31: "material positioned" should read -- material selectively positioned --.

Column 9, line 48, claim 31: "inductance." should read -- inductance without causing a corresponding increase in said pickup's DC resistance and to effectively cancel externally generated hum and noise. --.

Column 10, line 1, claim 33: "material positioned" should read -- material selectively positioned --.

Column 10, line 2, claim 33: "inductance." should read -- inductance without causing a corresponding increase in said pickup's DC resistance and to effectively cancel externally generated hum and noise. --.

UNITED STATES PATENT AND TRADEMARK OFFICE

CERTIFICATE OF CORRECTION

PATENT NO. : 5,908,998

DATED : June 1, 1999

INVENTOR(S) : Steven L. Blucher

It is certified that error appears in the above-identified patent and that said Letters Patent is hereby corrected as shown below:

Column 10, line 23: "material positioned" should read -- material selectively positioned --.

Column 10, line 24, claim 35: "inductance." should read -- inductance without causing a corresponding increase in said pickup's DC resistance and to effectively cancel externally generated hum and noise. --.

Signed and Sealed this

Sixth Day of February, 2001

*Attest:*

*Attesting Officer*

Q. TODD DICKINSON

*Director of Patents and Trademarks*